United States Patent [19]

Cowan et al.

[11] 4,207,942

[45] Jun. 17, 1980

[54] PLATE HEAT EXCHANGERS

[75] Inventors: Colin T. Cowan, Horley; Alan P. Crane, Burgess Hill, both of England

[73] Assignee: A.P.V. Company Limited, Crawley, England

[21] Appl. No.: 928,245

[22] Filed: Jul. 26, 1978

[30] Foreign Application Priority Data

Sep. 26, 1977 [GB] United Kingdom ..... 39995/77

[51] Int. Cl.[2] ..... F28F 3/00

[52] U.S. Cl. ..... 165/1; 165/133; 165/134 R; 165/167

[58] Field of Search ..... 165/134, 167, 133, 1; 204/147, 196

[56] References Cited

U.S. PATENT DOCUMENTS

| | | | |
|---|---|---|---|
| 1,020,480 | 3/1912 | Cumberland | 204/196 |
| 3,354,061 | 11/1967 | Foroulis | 204/196 |
| 3,560,365 | 2/1971 | Mueller | 204/196 |
| 3,690,373 | 9/1972 | Wright | 165/167 |
| 3,951,207 | 4/1976 | Baumann et al. | 165/134 |

FOREIGN PATENT DOCUMENTS

| | | | |
|---|---|---|---|
| 2244331 | 3/1974 | Fed. Rep. of Germany | 165/134 |

*Primary Examiner*—Sheldon Richter

*Attorney, Agent, or Firm*—Christel, Bean & Linihan

[57] ABSTRACT

For the purposes of corrosion protection of plate heat exchangers formed particularly of stainless steel or titanium, it is proposed to use anodic protection. To this end, in a plate heat exchanger comprising a pack of gasketted metal plates having aligned apertures to form supply and discharge ports for the heat exchange media, there is provided at least one electrode mounted in a manner to be insulated from the metal of the plates and extending along one of the ports formed by the aligned apertures.

6 Claims, 6 Drawing Figures

PLATE HEAT EXCHANGERS

This invention relates to plate heat exchangers and more particularly to the corrosion protection of plate heat exchangers.

A plate heat exchanger comprises a pack of plates of stainless steel, titanium or other corrosion resistant metal or alloy, arranged in spaced face-to-face relationship to define flow spaces between the plates. The flow spaces are normally bounded by gaskets and flow to and from the flow spaces is via aligned port-forming apertures in the plates. The ports so formed are normally in communication with alternate flow spaces and isolated from the intervening flow spaces by gaskets.

The technique of cathodic protection, in which a metal item to be protected is made the cathode has been widely adopted for many years in various arts, e.g. for the protection of mild steel piping or harbour installations. The well known process of galvanising is also a form of cathodic protection.

It is also known that corrosion protection can be achieved by anodic protection, i.e. applying a positive potential within a range varying with the metal to be protected, to a metal item, and this system has also been applied industrially for some time. For stainless steel the voltage range over which protection is given is very narrow so there is a need for control arrangements including a reference electrode. It will be appreciated that with anodic protection the effect of applying a positive potential outside the required range is to stimulate rather than inhibit corrosion. With titanium, the required range is quite wide so there is less need for sophisticated control arrangements. Anodic protection has the advantage that large areas can be protected with a small current flow, so that the running costs are low, and the process has found some industrial applications.

It has now been found possible to apply anodic protection to plate heat exchangers by fitting the required cathode, and reference electrode when desired, in the form of rods passing along the ports formed by the aligned holes in the plates and the present invention consists in a plate heat exchanger having at least one electrode mounted in an insulated manner in a port thereof.

The term plate heat exchanger is intended to encompass not only plate heat exchangers used for heat exchange without a change of phase, but also plate evaporators of the type wherein the feed liquid is maintained under pressure so that it does not boil between the plates but has the vapour removed subsequently by flashing.

Conveniently, in order to avoid complicating the liquid feed and discharge connections, the electrodes are introduced from and supported at the end of the ports opposite the feed and discharge connections and may be supported additionally at the connection end.

Figure 1:
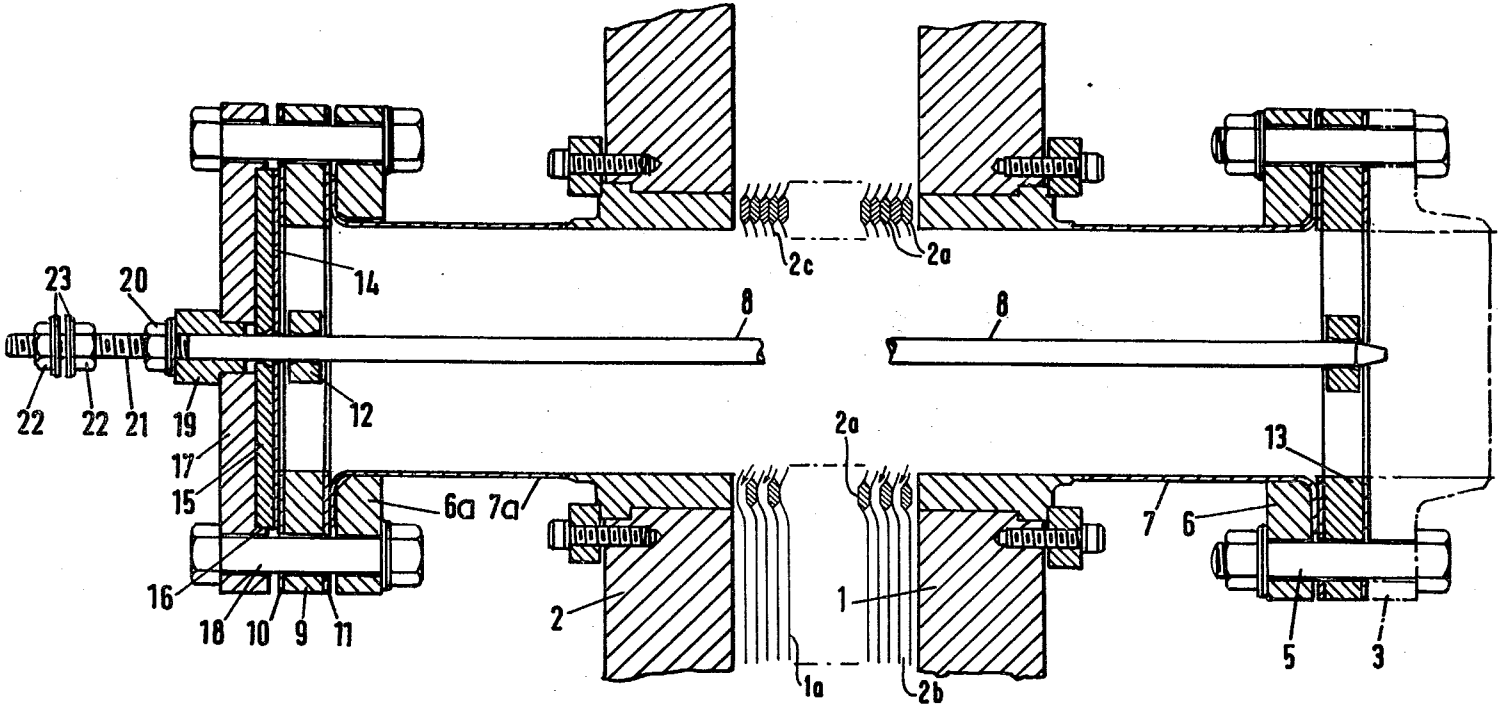

The invention will be further described with reference to the accompanying drawings, in which:

FIG. 1 is a sectional view illustrating the construction and location of a preferred form of cathode in a plate heat exchanger; and FIGS. 2 to 6 are diagrammatic views showing electrode arrangements for particular heat exchanger configurations.

Turning first to FIG. 1, it will be appreciated that the pack of plates 1*a* separated by gaskets 2*a* in a conventional heat exchanger is normally mounted in a frame, and the plates 1*a* are compressed between a fixed head which is shown at 1 in FIG. 1, and a movable follower, which is shown at 2. The head 1 and follower 2 form part of the frame. The details of the plates are omitted, as are details of the remainder of the frame, as these form no part of the present invention. Flow spaces between the plates are indicated by 2*b* and aligned holes 2*c* in the plates form ports, one of which is shown in FIG. 1.

As is conventional, a flange 3 on external pipework 4 is secured by bolts 5 to a flange 6 forming part of an adapter 7 mounted on the head 1. In a conventional single pass plate heat exchanger, the follower would not carry any connection, but in accordance with the preferred arrangement of the present invention, the follower 2 is shown as having a mounting for a rod cathode 8 which is mounted in the ports formed by the aligned holes 2*c*. This mounting comprises an adapter 7*a* similar to the adapter 7 and having a flange 6*a*. The mounting arrangement has to provide both electrical insulation and a hydraulic seal against the corrosive liquid in which the cathode 8 is immersed, as well mechanical support for the end of the cathode 8.

Next to the flange 6*a* there is located a spider flange 9 incorporating gaskets 10 and 11 on either side thereof and having a central hub 12 which provides mechanical support for the cathode 8. A similar spider flange 13 is provided at the head end for mechanical support of the free end of the cathode 8, and this spider flange 13 is compressed between the flanges 3 and 6 by the bolts 5. The cathode 8 carries a disc 14 welded thereto and preferably formed of the same material, e.g. Hastalloy C, and this disc 14 is compressed between the gasket 10 and an insulating plate 15, which is thus shielded from the corrosive medium. The plate 15 is itself mounted in a recess 16 in a support flange 17. Bolts 18 are provided to compress the assembly of the flange 17, the spider flange 9 and the flange 6*a* together.

The cathode 8 passes through apertures in the insulating plate 15 and flange 17, and carries an insulating bush 19 which is secured by a nut 20 mounted on a threaded end 21 of the cathode 8. Further nuts 22 and washers 23 provide a convenient location for an external electrical connection to the cathode 8.

It will be appreciated that while the structure illustrated in FIG. 1 is essentially for the support of a cathode in the form of an elongated rod, a similar arrangement can be used for the somewhat shorter reference electrode, although in such a case the second spider flange 13 could be omitted. Also, while FIG. 1 shows the external fluid connection on the head and the cathode mounted from the follower, certain flow arrangements might dictate a different set-up.

Reference will now be made to FIGS. 2 to 5 which show diagrammatically different flow arrangements and the corresponding arrangements of cathodes and reference electrodes where appropriate.

Figure 2:
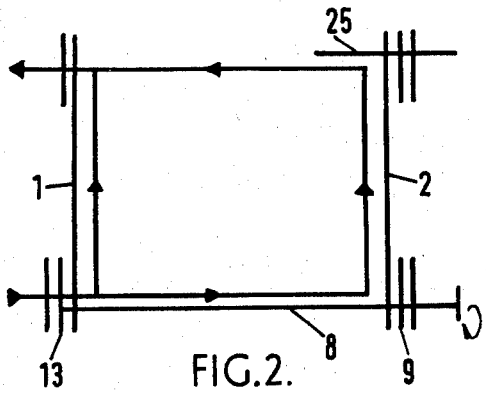

Dealing first with FIG. 2, there is shown a single pass arrangement with a head 1 and a follower 2. A cathode 8 is shown as being mounted on the feed side, and the two supporting spider flanges 9 and 13 are indicated diagrammatically. Where this arrangement is in a stainless steel heat exchanger, there will be need for a reference electrode, and this is shown at 25 as being mounted in the discharge port for the medium and extending from the follower end.

Figure 3:
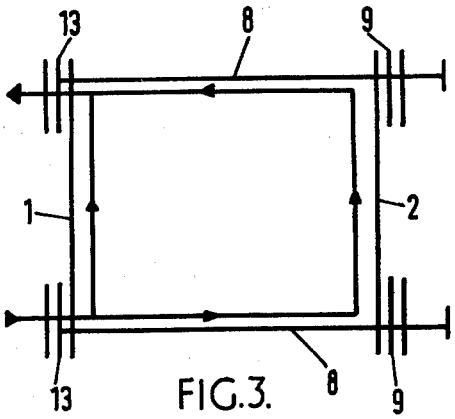

FIG. 3 shows a single pass arrangement where no reference electrode is needed, and illustrates how two cathodes 8 can be used in such a case, each being mounted on the follower 2 and one extending into each of the supply and discharge ports for one medium. The spider flanges 9 and 13 are again illustrated diagrammatically.

Figure 4:
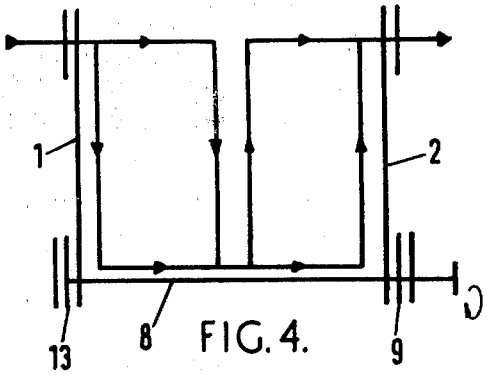

FIG. 4 illustrates a double pass heat exchanger having a feed connection on the head 1 and a discharge connection on the follower 2. Such an arrangement there is only one port for the medium in question which is free to accept an electrode, and a cathode is shown at 8 as extending from the follower where it is supported by the spider flange 9 to the head where it is supported by the spider flange 13. At the changeover between the passes, the port is open so the cathode 8 can pass right through. However, at the upper port as illustrated, there is a blank at the changeover.

Figure 5:
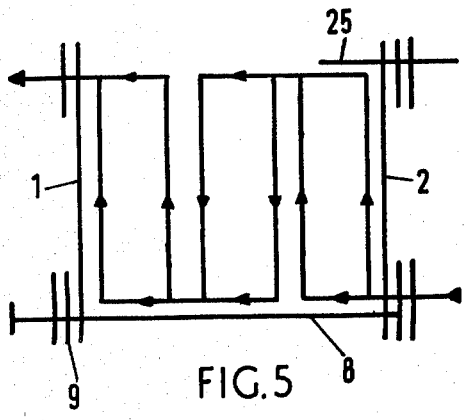

FIG. 5 shows a triple pass arrangement with a cathode 8 extending from the head 1 and the reference electrode 25 extending from the follower 2. At the changeover between the passes, the cathode 8 is sealed by an insulating bush fixed to the two pass plates through which it has to extend.

Figure 6:
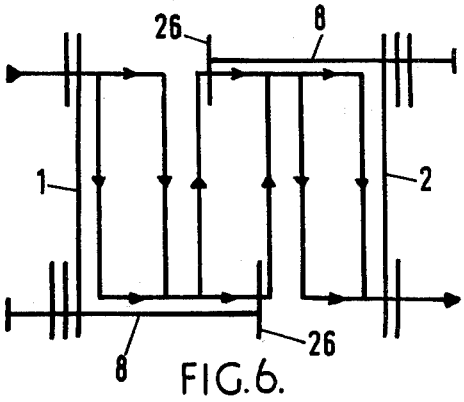

FIG. 6 shows an arrangement of a triple pass heat exchanger with no reference electrode, and here there are shown two cathodes 8 one extending from the head 1 and one from the follower 2, and each extending as far as the blank in the appropriate port. The free ends of the cathodes 8 are supported by spiders 26 adjacent the blank port.

Various modifications may be made within the scope of the invention.

We claim:

1. A method of operating a plate heat exchanger of the type comprising a pack of gasketed metal plates arranged in spaced face to face relationship to define flow spaces for heat exchange media between the plates, the plates having aligned apertures to form supply and discharge ports for the heat exchange media, the plate heat exchanger further including an electrode insulated from the metal of the plates and extending along one of the ports formed by the aligned apertures, in which the electrode is connected as a cathode and is maintained at an electrical potential such that the positive potential difference between the plates and the electrode is in the range for anodic protection.

2. In a plate heat exchanger comprising a pack of gasketed metal plates arranged in spaced face to face relationship to define flow spaces for heat exchange media between the plates, the plates having aligned apertures to form supply and discharge ports for the heat exchange media; the improvement that at least one electrode is mounted in a manner to be insulated from the metal of the plates and extending along one of the ports formed by the aligned apertures.

3. A plate heat exchanger as claimed in claim 2, comprising a second electrode, usable as a reference electrode to control the potential applied to the first mentioned electrode, the said second electrode being mounted in a different port for the same medium as the port in which the said first mentioned electrode is mounted.

4. A plate heat exchanger according to claim 2, in which the said port has a liquid flow connection at one end and in which the electrode is introduced from the opposite end of the port, and comprising means for supporting said electrode adjacent the said opposite end.

5. A plate heat exchanger as claimed in claim 4, further comprising means for supporting the said electrode adjacent the said one end of the port.

6. A plate heat exchanger as claimed in claim 4, in which the said supply means comprises an adaptor mounted on the frame of the heat exchanger and a spider mounted in electrically insulating manner in the adaptor and supporting the electrode.

* * * * *